US007879220B2

(12) United States Patent
Lorentsen et al.

(10) Patent No.: US 7,879,220 B2
(45) Date of Patent: Feb. 1, 2011

(54) METHOD AND MEANS FOR IMPROVING ELECTROLYSIS CELL OPERATION

(75) Inventors: Odd-Arne Lorentsen, Porsgrunn (NO); Stein Julsrud, Skien (NO); Christian Rosenkilde, Porsgrunn (NO)

(73) Assignee: Norsk Hydro ASA, Oslo (NO)

( * ) Notice: Subject to any disclaimer, the term of this patent is extended or adjusted under 35 U.S.C. 154(b) by 998 days.

(21) Appl. No.: 11/596,568

(22) PCT Filed: Jun. 3, 2005

(86) PCT No.: PCT/NO2005/000189

§ 371 (c)(1),
(2), (4) Date: Mar. 9, 2007

(87) PCT Pub. No.: WO2006/001699

PCT Pub. Date: Jan. 5, 2006

(65) Prior Publication Data

US 2008/0017518 A1 Jan. 24, 2008

(30) Foreign Application Priority Data

Jun. 25, 2004 (NO) ..... 20042688

(51) Int. Cl.
*C25C 3/08* (2006.01)
*C25C 3/14* (2006.01)

(52) U.S. Cl. ..... 205/392; 205/372; 205/389; 204/243.1; 204/245

(58) Field of Classification Search ..... 204/243.1, 204/245, 246, 247.2; 205/372, 392, 389
See application file for complete search history.

(56) References Cited

U.S. PATENT DOCUMENTS

| | | | |
|---|---|---|---|
| 2,464,267 | A | 3/1949 | Short |
| 4,276,145 | A | 6/1981 | Skala |
| 4,322,270 | A | 3/1982 | Skala |
| 4,389,287 | A | 6/1983 | Skala |
| 4,465,659 | A | 8/1984 | Cambridge et al. |
| 4,597,840 | A | 7/1986 | Cohen et al. |
| 5,720,868 | A | 2/1998 | Rendall et al. |
| 6,221,233 | B1 | 4/2001 | Rendall |

FOREIGN PATENT DOCUMENTS

| | | |
|---|---|---|
| SU | 1247432 A1 | 7/1986 |

OTHER PUBLICATIONS

Margaret Hyland et al., "Alumina Structural Hydroxyl as a Continuous Source of HF", Light Metals, pp. 361-366, 2004.
N. Aljabri et al., "HF Emission From Dubal's Electrolysis Cell", Light Metals, pp. 487-489, 2003.

*Primary Examiner*—Bruce F Bell
(74) *Attorney, Agent, or Firm*—Wenderoth, Lind & Ponack, L.L.P.

(57) ABSTRACT

The present invention relates to a method of improving the current efficiency (CE) in an electrolytic aluminum production cell with an electrolytic bath, at least one anode and at least one cathode, and passing current between said anode and said cathode through said bath and feeding an aluminum containing feedstock to the cell. The CE is improved in that the aluminum containing feedstock is prepared in a manner where it contains substantially no humidity or water before it is fed to the cell, where the electrolytic process is carried out at conditions with reduced amount of hydrogen present.

14 Claims, 1 Drawing Sheet

METHOD AND MEANS FOR IMPROVING ELECTROLYSIS CELL OPERATION

Figure 1:
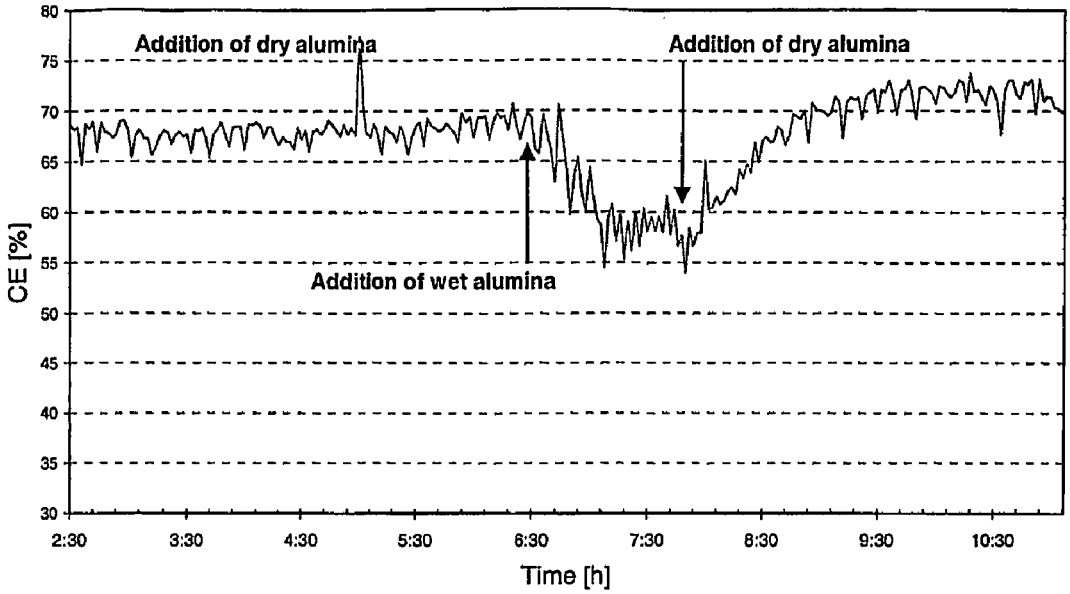

The traditional Hall-Héroult cells producing aluminium represent a mature industry, which is almost 120 years old. Operational process development, control and cost reductions over the last decades have made the competitions among the companies very tough. Incremental improvements give comparative advantages of great importance.

For the global aluminium industry a one-percent improvement of the current efficiency represents an extra metal value in the order of 300 millions USD. Even though there is not much room for improving the best cells with respect to the current efficiency (CE=96%), it is still possible to increase the average current efficiency. The current efficiency depends on chemical conditions, convection due to anodic gas release, magnetic fields, surface driven flow and cell geometry.

The feedstock of alumina is of major concern for all of the world's aluminium smelters. Lack of alumina causes anode effects, and too much alumina cause muck formation in the bottom of the cell. Neither of them is desired. Since the alumina feeding in Hall-Héroult cells is based on the so-called pseudo-resistance curve, the alumina concentration varies with several percent over a feed cycle and one has strived for an alumina feed stock that is easy to dissolve and distribute throughout the cell. The normal point feed stock has a balanced content of sandy and floury alumina, and gamma alumina with some moisture is normally desired because it dissolves easier than dry alpha alumina and increases the efficiency of the dry scrubber.

How the alumina concentration affects the current efficiency has been subject to considerable debate during the last decade, and the results reported in the literature vary considerably. Solli, Current Efficiency in Aluminium Electrolysis Cells, Dokoringeniør thesis no. 22, Norwegian Institute of Technology (NTH), Trondheim, Norway, 1993 measured the current efficiency in a laboratory cell fed with dry alpha alumina. No influence of alumina concentration on the CE was found. On the other hand, Leroy et al. Continous Measurements of Current Efficiency by Mass Spectroscopy on a 280 kA Prototype Cell, Light Metals 1987, pp. 291-294 reported a large decrease by 1 to 3% current efficiency per 1 wt % alumina increase in industrial cells, which is supported by the findings of Tarcy, Strategies for Maximizing Current Efficiency in Commercial Hall-Héroult Cells, Proceedings from the $5^{th}$ Australasian Aluminium Smelting Technology Conference and Workshop, Sydney, pp. 139-160, 1995. Earlier studies [Grjotheim, K., Krohn, C., Malinovskỳ, M. Matia šovskỳ, K and Thonstad, J., *Aluminium Electrolysis Fundamentals of the Hall-Héroult Process,* $2^{nd}$ ed., Aluminium-Verlag, Dusseldorf, ISBN 3-87017-155-3, pp. 28-31, 1982] reported the eutectic point in the $Na_3AlF_6$—$Al_2O_3$ to vary over a wide range, i.e. 12.0-19.8 wt % alumina and 935-948° C. Some of the variation can be explained by, for example, varying content of impurities in the cryolite, but it is not evident how the types of alumina used may have affected the solubility of oxide by introduction of additional solubility of structural hydroxyl from the chemisorbed water in the alumina.

The link between moisture in alumina and HF generation in aluminium reduction cells has been long established. The assumption has usually been that loosely bound and adsorbed water is generating HF via bath hydrolysis when the surface water is quickly flashed off during alumina feeding. However, Hyland et al. [Hyland, M, Patterson, E. and Welch, B, *Alumina Structural Hydroxyl as a Continuous Source of HF*, Light Metals 2004, TMS, pp. 361-366, 2004] reported that structural water, or more correctly, structural hydroxyl incorporated in the alumina lattice, makes a larger contribution to HF generation than surface adsorbed water. Their laboratory experiments showed that hydroxyl dissolves in molten cryolite and leads to HF formation.

With the present invention it is possible to increase the current efficiency (CE) in electrolysis cells producing aluminium.

This and further advantages can be achieved in accordance with the invention as defined in the accompanying claims.

Figure 2:
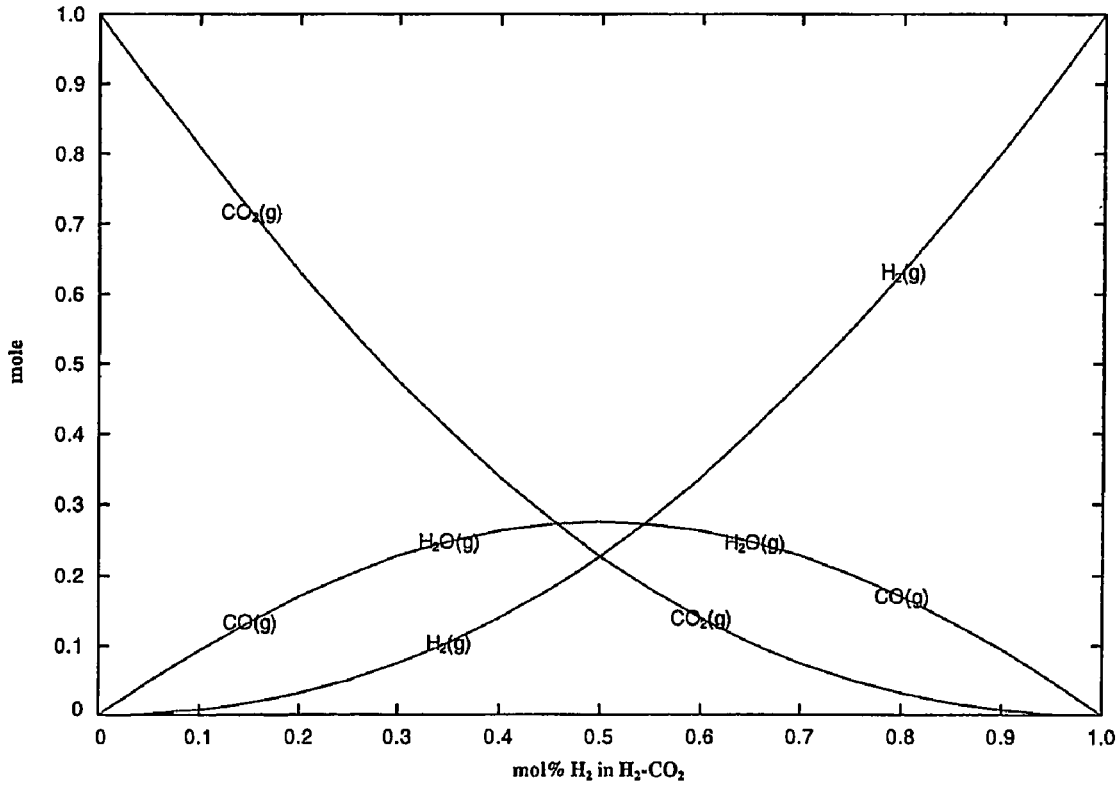

The invention shall be further explained by examples and Figures where:

FIG. 1 discloses variation in current efficiency (CE), using inert anodes, at constant voltage (ER 8) by addition of two different alumina qualities with and without moisture, respectively. FR 29 shows gas flow from the cell and ER 9 is total current, FIG. 2 discloses equilibrium concentrations resulting from reaction with $H_2$ and $CO_2$ at 960° C. and 1 atm total pressure. The horisontal axis is the amount of $H_2$ in the reactant $H_2$—$CO_2$ mixture.

By experiments carried out in laboratory cells with oxygen evolving anodes, it has been measured that the current efficiency can be substantially improved by reducing the content of water/hydroxides in the alumina fed to the cell (see FIG. 1).

Water is introduced to the cell mainly from alumina. Some water may also be introduced by the fluoride, replaced anodes and by the introduction of humid ambient air since the closed cells usually are operated at underpressure by a gas extraction equipment.

Commercial alumina has about 1-2 weight % water, which is mainly absorbed at the large surface area inside the alumina agglomerates (in the order of 100 $m^2/g$ gamma alumina). If one assumes all the water to oxidise aluminium according to the reaction:

$$3H_2O+2Al=Al_2O_3+3H_2 \quad (1)$$

a loss of 1.9% current efficiency per weight percent water in the alumina is calculated. Experience from a laboratory cell with oxygen evolving anodes shows that the effect of moisture in alumina is much larger the estimated 1.9% loss in CE pr. 1% water in alumina. Thius indicates that $H^+$ is reduced several times, probably due to a shuttle reaction caused by reduction of $H^+$ and subsequent reaction of the produced hydrogen with oxygen from the anode.

It is believed that similar negative effects of hydrogen/water will apply in a Hall-Héroult cell with carbon-based anodes, although possibly to a smaller extent. Thermodynamic calculations show that hydrogen can react with $CO_2$ under the formation of CO and $H_2O$, see FIG. 2. The water formed in this reaction may dissolve in the electrolyte and react on the cathode or with cathode products under the formation of $H_2$, which can react with $CO_2$. This loop may be repeated several times causing significant loss in CE even at low moisture levels. It should be understood that the reaction in accordance with equation 1 can be achieved in cells with oxygen evolving anodes, in cells with carbon anodes, and in cells with both carbon anodes and oxygen evolving anodes.

In the following the invention will be further described:

Feeding dry alumina has shown to have a major impact on the current efficiency using inert anodes that produce oxygen. Heat-treating the feedstock from standard gamma alumina with approximately 3% moisture reduced the moisture to less than 0.03%, which resulted in an increase of the current efficiency from 65% to 85%.

The observation is most probably related to the reaction between $H^+$ in e.g. water, HF or dissolved hydroxide with metal (e.g Na or Al) in the cathode or dissolved in the electrolyte:

$$3H^+Al = Al^{3+} + 3/2H_2 \quad (2)$$

The protons (free or bound to O or F) diffuse or migrate to the cathode where they are reduced to hydrogen, either dissolved or as a gas. The hydrogen will then which react with the produced oxygen from the anode producing water again. The retention time of hydrogen is apparently quite high, and causes the parasitic reaction to occur several times before the hydrogen leaves the electrolyte with a serious impact on the current efficiency of aluminium production. The hydrogen leaves the cell probably either as $H_2O$, HF, $H_2$ or as H dissolved in Al.

A way to reduce the water (hydrogen) is to produce hydrogen free alumina with no water and/or chemically bonded OH-groups. This can be achieved e.g. by high-temperature calcination or longer calcination times during the alumina production by the Bayer process. It is, however, claimed that these types of alumina is not so easy to dissolve as gamma-alumina with chemisorbed water. The dissolution may be improved by reducing the particle size of the feed stock alumina and/or feeding in areas with enhanced electrolyte flow, for instance generated by gas bubbles at the anodes. Reducing the feed batch size and feed more frequently will also benefit the dissolution conditions.

The optimum alumina feed stock may alternatively be represented by dry bubble alumina, dried alpha alumina or other alumina morphologies with low settling rates.

It should be understood that the alumina feedstock may also be a mixture of various prepared aluminium containing feedstocks with low content of water.

Further, in an particular embodiment everything that is added to the cell should be dried (ex. $AlF_3$, $Na_2CO_3$, carbon anodes, alumina, crushed bath).

Reduced water addition by using fluorides with low moisture content and minimising air flow through the cell will also lead to increased current efficiency. Drying the air that enters the cell will also reduce the water uptake.

Conventionally, the cell is connected to a gas extraction system. In one embodiment the cell is closed (substantially gas-tight) to minimise flow of ambient air through the cell.

In one embodiment the water, or humidity, is removed from the aluminium-containing feedstock in a processing unit, immediately before it is fed to the cell or at any other appropriate location. This can be a processing unit integrated in the feedstock transport system (not shown). It should be mentioned that in a fluidised transport system, the fluidising gas should be dried.

In one other embodiment of the invention, the hydrogen content, measured as HF content in the cell should be maintained lower than 100 ppm, or even better, below 50 ppm.

Reduced moisture addition to the cell will also reduce HF emissions, and reduce the need for HF purification accordingly.

The invention claimed is:

1. A method of improving the current efficiency (CE) in an electrolytic aluminium production cell with an electrolytic bath, at least one anode and at least one cathode, said method comprising passing a current between said anode and said cathode through said bath, removing substantially all water or humidity from an alumina containing feedstock with a processing unit and then immediately feeding the alumina containing feedstock to the cell, wherein the electrolytic process is carried out under conditions with a reduced amount of chemically bound hydrogen present.

2. The method in accordance with claim 1, wherein the alumina containing feedstock comprises mostly dried alpha alumina.

3. The method in accordance with claim 1, wherein the alumina containing feedstock comprises mostly dried bubble alumina, or other low density alumina powders.

4. The method in accordance with claim 1, wherein the alumina containing feedstock comprises mostly highly calcined alumina.

5. The method in accordance with claim 1, wherein everything that is added to the cell is dried.

6. The method in accordance with claim 5, wherein dried $AlF_3$, $Na_2CO_3$, carbon anodes, alumina or crushed bath is added to the cell.

7. The method in accordance with claim 1, wherein the water/HF content in the cell is maintained lower than 100 ppm.

8. The method in accordance with claim 7, wherein the water/HF content in the cell is maintained lower than 50 ppm.

9. The method in accordance with claim 1, where the cell is connected to a gas extraction system, and the cell is closed to minimise flow of ambient air through the cell.

10. The method in accordance with claim 1, where the cell is connected to a gas extraction system, and ambient air/gas is dried before it is allowed to enter the cell.

11. The method in accordance with claim 1, wherein the cell is a Hall-Héroult cell.

12. A means for improving the current efficiency (CE) in an electrolytic aluminium production cell with an electrolytic bath, at least one anode and at least one cathode, wherein a current is passed between said anode and said cathode through said bath, substantially all water or humidity is removed from an alumina containing feedstock with a processing unit and the alumina containing feedstock is immediately fed to the cell, wherein the cell has provisions for restricting water or humidity to enter said cell.

13. The means in accordance with claim 12 where the cell is closed and provided with a gas extraction system, wherein the cell is provided with a unit that removes humidity or water from the air/gas that is allowed to be sucked into the closure of the cell.

14. The means in accordance with claim 12, wherein the cell is a Hall-Héroult cell.

* * * * *